US006112559A

United States Patent [19]

Zanette

[11] Patent Number: 6,112,559

[45] Date of Patent: Sep. 5, 2000

[54] HIDE STRETCHING APPARATUS

[75] Inventor: Michele Zanette, Treviso, Italy

[73] Assignee: Emilio Buttazzi, Bassano Del Grappa, Italy

[21] Appl. No.: 09/068,234

[22] PCT Filed: Nov. 5, 1996

[86] PCT No.: PCT/EP96/04827

§ 371 Date: May 5, 1998

§ 102(e) Date: May 5, 1998

[87] PCT Pub. No.: WO97/17472

PCT Pub. Date: May 15, 1997

[30] Foreign Application Priority Data

Nov. 6, 1995 [IT] Italy ..... VI95A0173

[51] Int. Cl.[7] ..... C14B 1/26

[52] U.S. Cl. ..... 69/19.1; 69/47; 69/48; 100/208; 100/209

[58] Field of Search ..... 69/1, 1.5, 47, 48, 69/19, 19.1, 19.2; 100/193, 194, 208, 209, 221, 151

[56] References Cited

U.S. PATENT DOCUMENTS

| | | | |
|---|---|---|---|
| 3,638,559 | 2/1972 | Parker | 100/208 |
| 3,824,058 | 7/1974 | Axer et al. | 100/209 |
| 5,184,487 | 2/1993 | Corner | 69/19.1 |

FOREIGN PATENT DOCUMENTS

| | | | |
|---|---|---|---|
| 288264 | 10/1988 | European Pat. Off. | 69/19.1 |
| 0 368 233 | 5/1990 | European Pat. Off. . | |
| 368233 | 5/1990 | European Pat. Off. | 69/19.1 |
| 504579 | 9/1992 | European Pat. Off. | 69/19.1 |
| 2 325 718 | 4/1977 | France . | |
| 2351307 | 4/1975 | Germany | 69/48 |
| 883012 | of 1969 | Italy . | |
| 809179 | 1/1959 | United Kingdom . | |
| 1016191 | 1/1966 | United Kingdom . | |

*Primary Examiner*—Michael A. Neas
*Attorney, Agent, or Firm*—Ladas & Parry

[57] ABSTRACT

A modular oscillating head, particularly for stretching and softening industrial hides and similar products, comprising flexible mats (31, 32) for the continuous longitudinal advancement of the hides between at least one pair of plates with facing tools upon which actuation means act for producing their relative oscillation along a working plane (n) substantially perpendicular to that of the advancement. Two moving plates (7, 8) are provided anchored to respective beating bodies (3, 4) positioned on opposite sides with respect to a fixed supporting structure (2) along the working plane (π). The beating bodies (3, 4) are provided with a symmetrical oscillating movement with respect to the central structure in the working plane (π). The actuation means comprise a pair of connecting rod and crank mechanisms acting on the transverse end portions of the beating bodies, and are formed by connecting rods (11, 12; 21, 22) connected to respective eccentric cams (15, 16; 25, 26) having an angular staggering (B) substantially equal to 180° for producing the alternated symmetrical motion in opposite phase of the beating bodies (3, 4).

15 Claims, 5 Drawing Sheets

FIG. 8
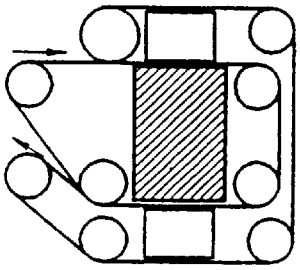
FIG. 9
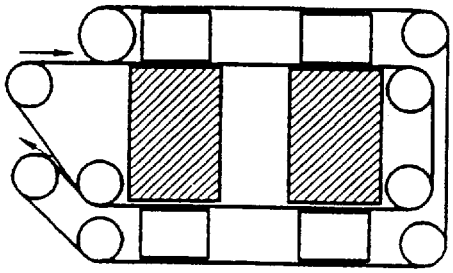
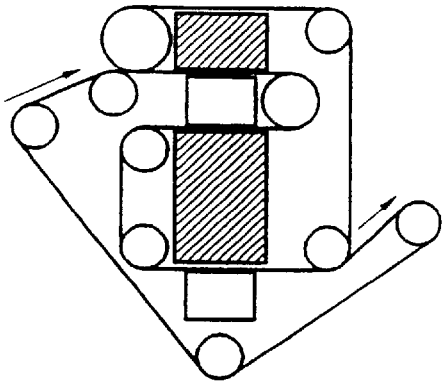
FIG. 10
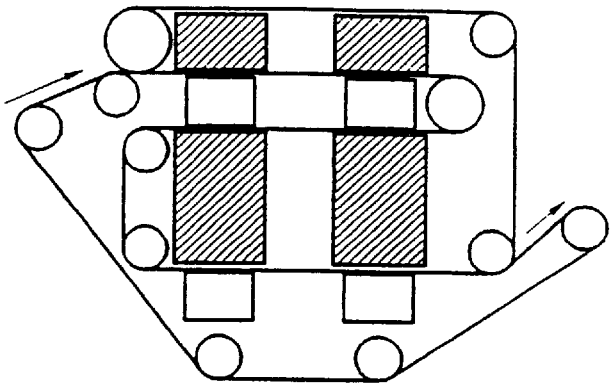
FIG. 11
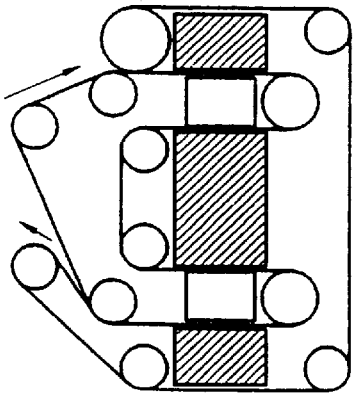
FIG. 12
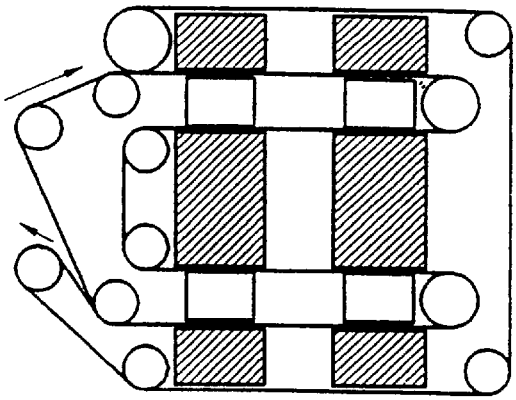
FIG. 13

HIDE STRETCHING APPARATUS

TECHNICAL FIELD

The present invention relates to a modular stretching head and machine, particularly for stretching and softening industrial hides and flexible laminous products.

The field of application of the invention is that of the tanning industry, and in particular that of stretching machines which serve to soften the hides after the tanning and drying treatment and to stretch them so as to increase their surface area and accordingly their market value.

BACKGROUND ART

Stretching machines are known essentially formed by a robust bench upon which one or more motorised work heads are mounted through which the hides to treat are made to advance, driven in a substantially horizontal direction by reciprocatingly facing flexible mat pairs.

Each work head is formed by at least one pair of beating masses or bodies to which plates or dies of appropriately shaped tools are connected, adapted to reciprocatingly interact in a manner to stretch the fibres of the interposed hides. To this end, at least one of the plates is provided with a relative movement towards and away with respect to the other plate in a work plane substantially perpendicular to that of advancement of the hides.

Examples of stretching machines of the above indicated type are illustrated, for example, in the patents IT-A-883 012, FR-A-2 325 718, GB-A-809 179, GB-A-1 016 191, and EP-A-0 368 233.

In such known machines the alternative movements of the plates are generally obtained by means of connecting rod and crank mechanisms, or by means of eccentrics or cams placed in rotation by a driving shaft connected to a motor which is independent or common to all the heads.

A recognised inconvenience of these known machines consists in the notable vibrations created by the oscillating movements of the bodies in motion. Such vibrations damage the structure and are sources of excessive sonorous emissions.

To this end, on the principal shaft of the machine or of each head there is normally applied a fly-wheel mass which serves to confer uniformity to the motion. However, the presence of such fly-wheel mass cannot completely eliminate the vibrations created by the alternative motion of the plates. Such residual vibrations accelerate fatigue wear to the structure with consequent reduction in reliability and in the average life of the machine as a whole.

In order to further limit the vibrations it has been proposed to provide machines with multiple working heads staggered in a horizontal plane, reciprocatingly connected by appropriate synchronisation means adapted to maintain the oscillating adjacent plates in opposite phase. This solution, described and claimed in the patent EP-A-0 504 579 which is incorporated herein by reference, does not allow however to eliminate the reaction moments created by the inertial forces of the adjacent plates and therefore it does not completely solve the problems of the vibrations.

Another inconvenience of the known past machines is constituted by their lack of flexibility, in that the number of initial heads and the dimensions of the supporting structure may not be successively modified for increasing the potentiality of the machine. Moreover, each head carries out only one treatment of the hides at a time and therefore in order to increase the productivity of the machine the number of heads and therefore its cost must be increased.

Another inconvenience of known stretching machines is constituted by their notable dimensions and weights which, in addition to limiting the maximum working frequency, brings about a major production cost and elevated consumption.

DISCLOSURE OF THE INVENTION

A principal object of the present invention is to overcome the inconveniences set forth above, by providing a perfectly balanced stretching head and machine, which allows to completely eliminate the vibrations created by the beating plates, so as to notably increase the reliability and life of the machine and reduce the necessity of maintenance.

A further object is to provide a head of simplified and modular form having a low cost, and which allows to modify and expand the initial machine without substantial structural modifications.

With these and other objects which will appear more clear hereinafter in view, there is provided a modular oscillating stretching head, particularly for stretching and softening industrial hides and similar products, comprising means for the longitudinal continuous advancement of the hides along at least one substantially horizontal plane, at least one pair of plates with facing tools acting on opposite sides of the hides to be treated, and actuation means acting on at least one of said plates for providing the relative oscillation thereof along a work plane substantially perpendicular to the advancement plane. The stretching head is characterised by the fact that it includes a central fixed structure and at least one pair of beating bodies provided with respective work plates and positioned on opposite sides with respect to the fixed supporting structure, in which the beating bodies are provided with a alternative symmetrical movement with respect to the central structure along the work plane.

In a second aspect of the invention, a modular balanced machine is provided, characterised by the fact of being formed by one or more working heads of the type described above, reciprocatingly connected in positions longitudinally staggered or superimposed along the plane of advancement.

Due to this "boxer" type configuration of the beating bodies, an excellent dynamic balance in all the operating conditions and a reduction of the sonorous emissions is obtained.

Moreover, the simplified structure of the head permits a notable reduction of weight and bulk with equal working efficiency.

The machine as a whole permits notable production economy, as well as a modularity and expandability differed in time.

BRIEF DESCRIPTION OF DRAWINGS

The invention will be now better clarified in light of the following detailed description of some exemplifying and non-limiting embodiments of a stretching head and machine, illustrated with the aid of the appended drawing sheets in which:

FIG. 8 represents a lateral schematic view of a first embodiment of a machine according to the invention;

FIG. 9 represents a lateral schematic view of a second embodiment of a machine according to the invention;

FIG. 10 represents a lateral schematic view of a third embodiment of a machine according to the invention;

FIG. 11 represents a lateral schematic view of a fourth embodiment of a machine according to the invention;

FIG. 12 represents a lateral schematic view of a fifth embodiment of a machine according to the invention; and FIG. 13 represents a lateral schematic view of a sixth embodiment of a machine according to the invention.

BEST MODES FOR CARRYING OUT THE INVENTION

Figure 1:
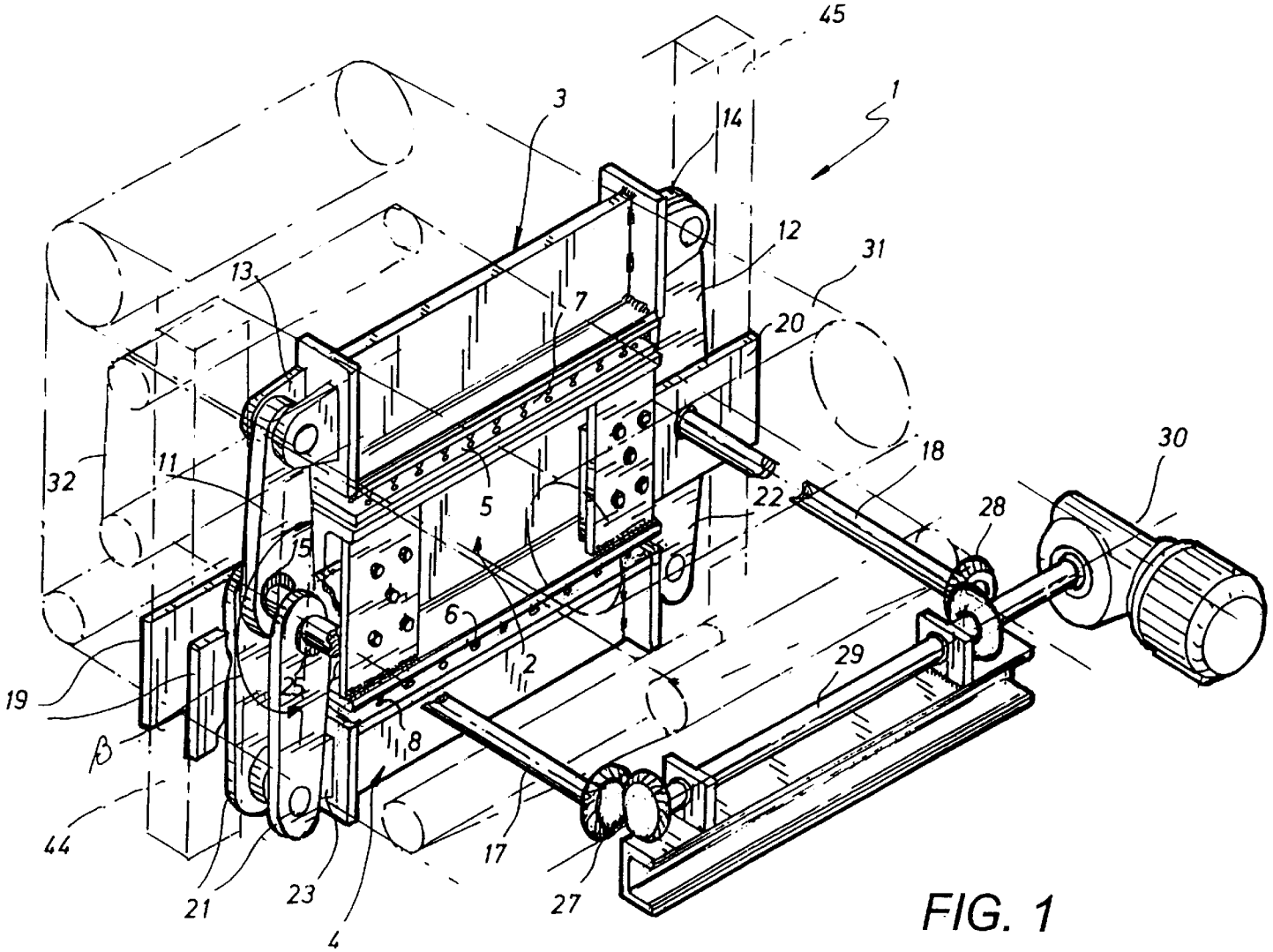
FIG. 1 illustrates a schematic perspective view of a first embodiment of a working head according to the invention.

With reference to the cited figures, a modular stretching head according to the invention, generally indicated by the reference numeral 1, serves to stretch hides or similar products which advance along substantially horizontal planes $\partial_1$, $\partial_2$ and directions $V_1$, $V_2$.

The head 1 according to the invention essentially comprises a supporting structure 2 with a symmetrical central axis a substantially perpendicular to the direction V of advancement of the hides. Connected to the supporting structure 2, in a manner which will be become better clarified hereinafter, are beating masses or bodies, respectively an upper one 3 and a lower one 4, substantially parallel to the central axis a.

In practice, the structure 2 may be constituted by a beam segment in steel with a normalised profile, with a vertical central portion and with upper and lower horizontal platbands. Analogously, the beating bodies 3, 4 may also be formed by steel profiled segments, for example with a T-section but with dimensions smaller than those of the central structure.

Removably connected on the upper and lower platbands of the central structure 2, are respective plates 5, 6 provided with shaped tools of various types, facing corresponding plates 7, 8 removably connected to the internal faces of the beating bodies 3, 4 and provided with counter-shaped tools.

Opportunely, according to the invention, there are provided actuation means which impart an alternated symmetrical movement to the beating bodies 3, 4 with respect to the central axis a of the structure 2 along a substantially vertical working plan $\pi$.

Preferably, such actuation means are constituted by mechanisms of the connecting rod and crank type, positioned at the sides of each beating body.

In particular, the connecting and actuation mechanisms for the upper beating body 3 are constituted by a pair of substantially vertical connecting rods 11, 12 articulated upwardly to respective forks 13, 14 joined to the sides of the same beating body and articulated downwardly to respective identical eccentric cams 15, 16.

The eccentric cams are formed on respective rotatable driving shafts 17, 18 with substantially horizontal axes mounted on corresponding lateral supports 19, 20 joined on the lateral ends of the central structure 2. The eccentric cams 15, 16 have identical dimensions and are always in phase such that the continuous rotation of the driving shafts 17, 18 provides the parallel oscillation of the beating body 3 with respect to the central structure 2, and therefore the alternated parallel motion of the plate 7 with respect to the plate 5.

Analogously, the actuation mechanisms for the lower beating body 4 may be constituted by two pairs of facing connecting rods 21, 22 with lower ends articulated to respective brackets 23, 24 and with lower ends mounted on corresponding eccentric cams 25, 26 which are also formed on axes 19, 20. Also in this case, the eccentric cams 25, 26 will mutually be in phase so as to provide the oscillation of the lower beating body 4, and therefore of the plate 8, parallelly to the central structure 2, and therefore to the plate 6.

According to the invention, the eccentric cams 15, 16 connected to the lower beating body 3 have an angular stagger $\beta$ equal to about 180° with respect to the corresponding eccentric cams 25, 26 connected to the lower beating body 4. To this end, the shafts 17, 18 may be reciprocatingly connected by means of respective conical gear pairs 27, 28 to a transverse axle 29, in turn driven by an electric reducer motor 30.

In order to confer major uniformity to the motion and to overcome the major resistances in the positions of engagement with the hides, the shafts may be provided with respective fly-wheels 17', 18' of appropriate dimensions.

Due to the angular staggering of the eccentric cams, the beating bodies 3, 4 provide a rigorous symmetrical movement and in each instance opposite with respect to the central axis a of the central structure 2.

In this manner, the forces of inertia acting on the structure always have an equal intensity and an opposite direction, with a constantly zero resultant. Due to the fact that the symmetrical movement of the beating bodies 3, 4 occurs along the same plane, reaction moments in a horizontal plane are not generated, eliminating every form of vibration and allowing a rotation system notably superior to that of past machines.

For promoting the advancement of the hides, there are provided two flexible closed-ring mats of a per se known type, indicated respectively by 31, 32, the first of which is subtended by rollers 33, 34, 35, 36, 37 and the second by rollers 38, 39, 40, 41 all of which are mutually parallel. The flexible mats 31, 32 present two substantially horizontal zones in reciprocal contact for holding the hides and advancing them along two parallel planes adjacent the work plates 7, 8 respectively connected to the external surfaces of the central supporting structure 2.

Figure 3:
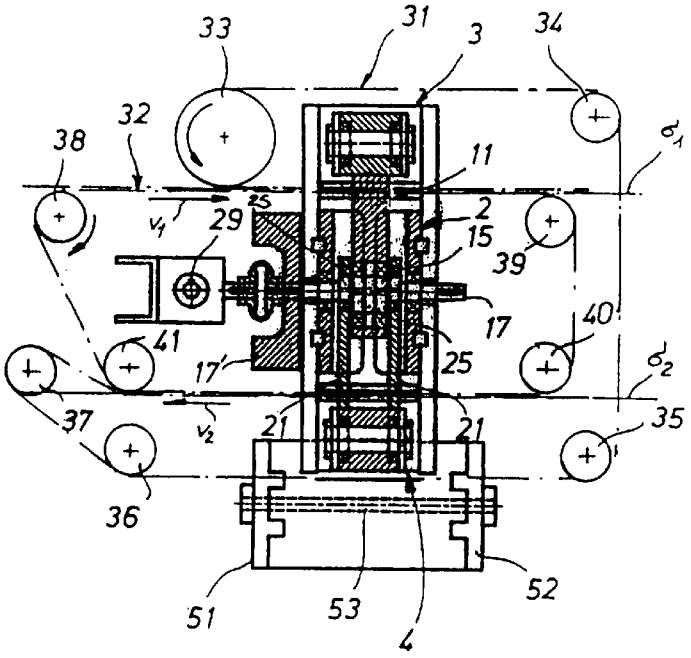
FIG. 3 represents a lateral view of the head of FIG. 2 partially sectioned according to the section plane III—III.
Figure 2:
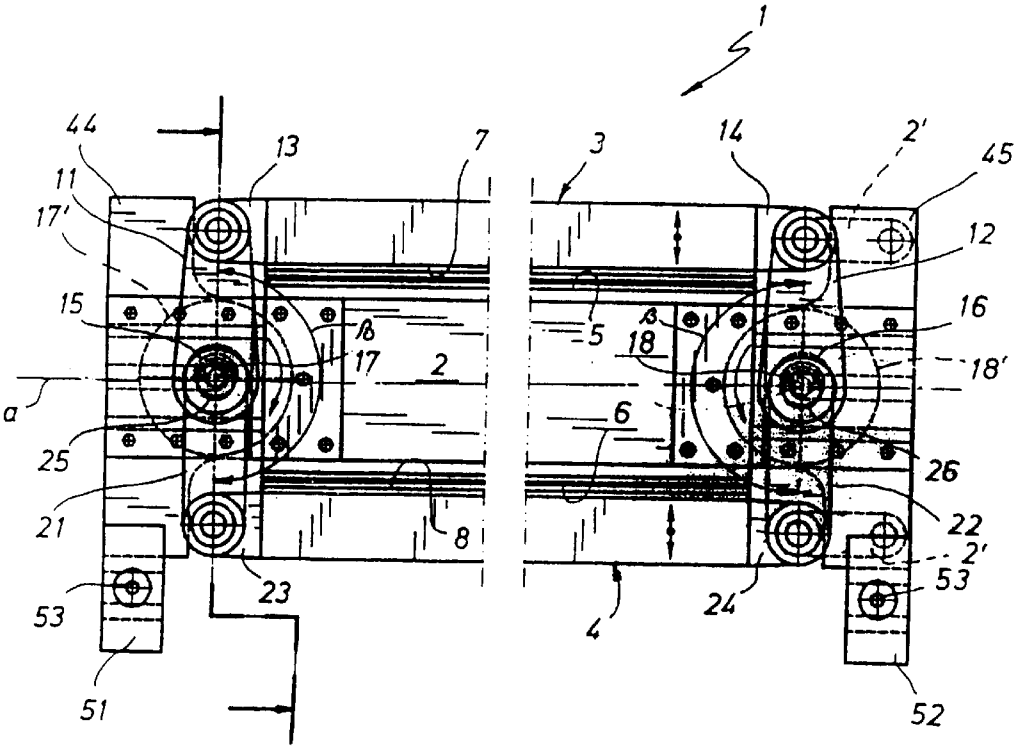
FIG. 2 illustrates a front view of the head of FIG. 1.

The head illustrated in the FIGS. 1 to 3 therefore has the advantage of providing, in an extremely reduced space, two pairs of relatively light work plates, capable of treating the hides in succession, thereby to enormously reduce the dimensions of the machine.

Figure 5:
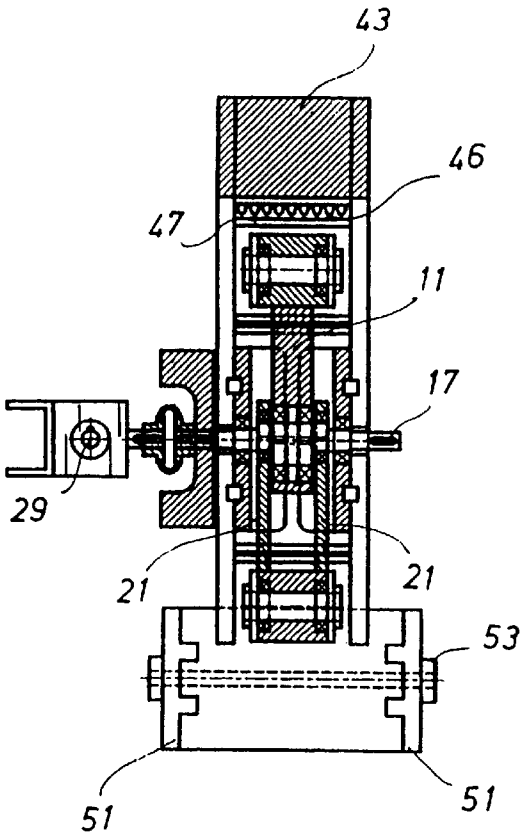
FIG. 5 represents a lateral view of the head of FIG. 4 partially sectioned according to the section plane V—V.
Figure 4:
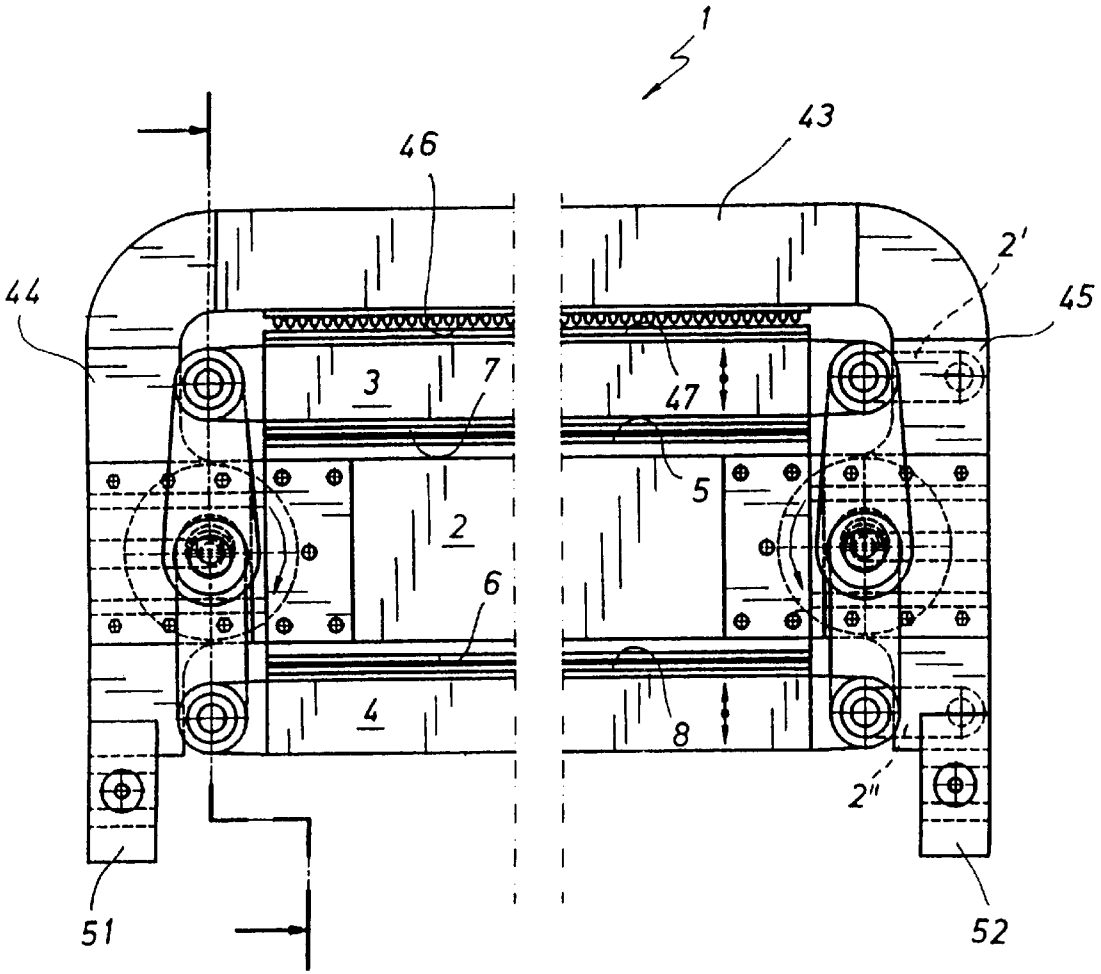
FIG. 4 illustrates a front view of a second embodiment of the head according to the invention.

The head represented in the FIGS. 4 and 5 differs from that of the FIGS. 1 to 3 only for the presence of an upper crosspiece 43 connected to the supporting structure 2 by means of a pair of uprights 44, 45 and provided with, on an internal face, a work plate 46 adapted to cooperate with a corresponding plate 47 connected to the external face of the beating body 3. This configuration in practice provides a stretching head with three pairs of working plates. In order to guarantee stable conditions, the beating bodies 3, 4 may be connected to the fixed structure by means of suspension connecting rods 2', 2" joined to one of the vertical uprights 45.

Figure 7:
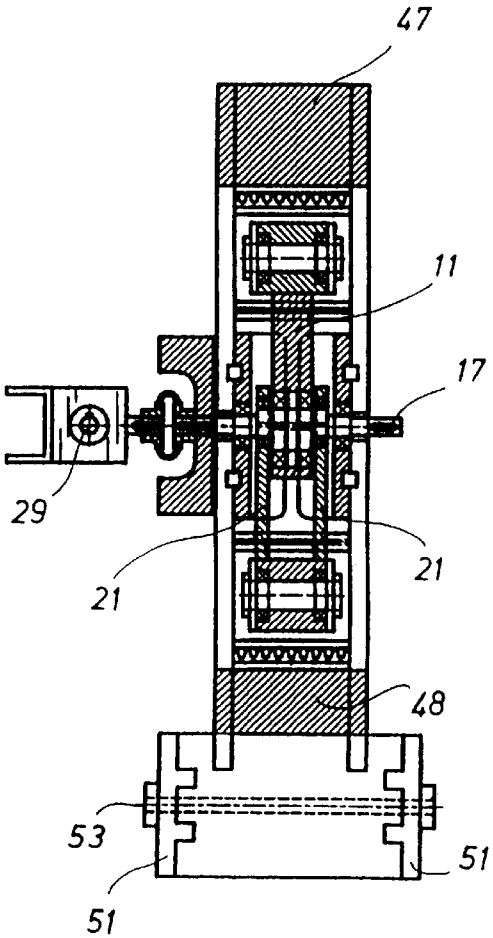
FIG. 7 represents a lateral view of the head of FIG. 6 partially sectioned according to the section plane VII—VII.
Figure 6:
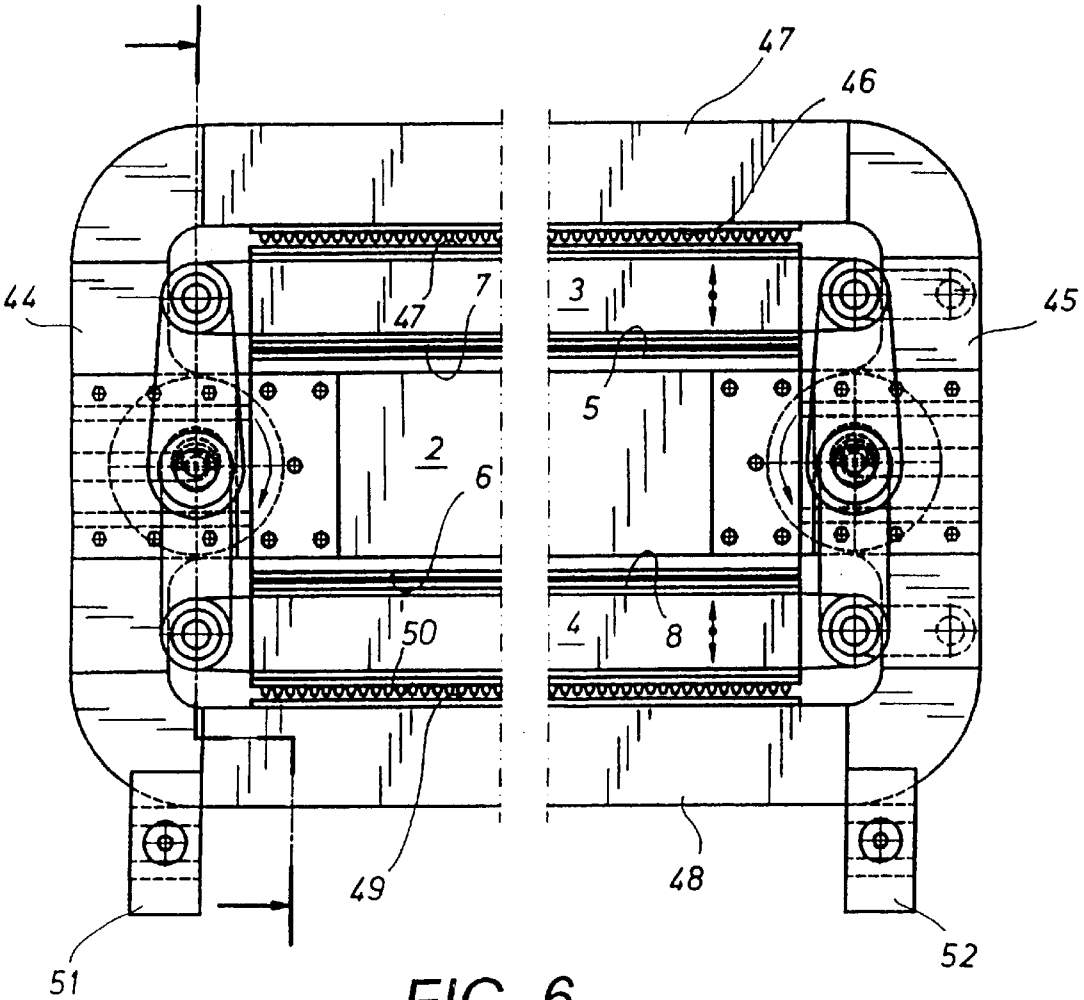
FIG. 6 illustrates a front view of a third embodiment of the head according to the invention.

The stretching head illustrated in the FIGS. 6 and 7 differs from that of the FIGS. 4 and 5 for the presence of another lower crosspiece 48 connected to the uprights 44, 45 and provided with a respective work plate 49 facing towards the inside and adapted to cooperate with a corresponding plate 50 aligned and connected to the external side of the beating body 4.

All of the heads shown in the preceding figures provide connection means, constituted for example by brackets 51, 52 coupled by screws 53 for the connection of each single head to other similar ones, in positions horizontally staggered or vertically superimposed.

In the FIGS. 8 to 13 there are illustrated combinations of modular heads of the above described type in a manner to provide stretching machines, respectively with two, four, and eight pairs of work plates, in positions staggered in longitudinal direction or reciprocatingly superimposed along the plane of action of the plates.

From what has been described above, it appears evident that the device according to the invention reaches all of the prefixed objects, and in particular it is underlined the absolute absence of vibrations, the extreme simplicity, compactness, economy and flexibility of the stretching heads and of the stretching machines resulting from their combination.

The head and the machine according to the invention are susceptible to numerous modifications and variations which all fall within the scope of protection of the appended claims.

What is claimed is:

1. Oscillating modular head, for stretching and softening industrial hides comprising:

means for the longitudinal continuous advancement of the hides along at least one substantially horizontal plane;

at least one pair of work plates with facing tools acting on opposite sides of the hides to be treated;

actuation means acting on at least one of said work plates providing the relative oscillation thereof along a work plane substantially perpendicular to said horizontal plane; and a central fixed supporting structure;

at least one pair of beating bodies respectively provided with one of said work plates and positioned on opposite sides with respect to said central fixed supporting structure;

wherein said actuation means are connected to said at least one pair of beating bodies to impart to them alternative symmetrical movement with respect to said central fixed supporting structure along said work plane.

2. Modular head according 1, wherein said actuation means comprise a pair of connecting rod and crank mechanisms acting on transverse end portions of said beating bodies.

3. Modular head according to claim 2, wherein each one of said said beating bodies has in proximity of its transverse end portion a pair of end joints for the connection with said connecting rod and crank mechanisms.

4. Modular head according to claim 3, wherein each end joint is connected to a respective crank by means of a substantially vertical connecting rod.

5. Modular head according to claim 4, wherein said connecting rods are connected to respective eccentric cams defining the cranks of said mechanisms, said eccentric cams being formed on substantially horizontal driving shafts.

6. Modular head according to claim 5, wherein said driving shafts are rotatably mounted on lateral supports of said fixed supporting structure.

7. Modular head according to claim 5, wherein the eccentric cams of each driving shaft present an angular staggering substantially equal to 180° for providing alternated symmetrical synchronous motion of said beating bodies.

8. Modular head according to claim 1, wherein a fixed crosspiece is rigidly coupled to said fixed central structure to cooperate with said beating bodies.

9. Modular head according to claim 8, wherein a respective work plate is connected with an internal face of said fixed crosspiece to interact with an opposing work plate connected to an external face of an adjacent beating body.

10. Modular head according to claim 1, wherein said beating bodies present, in correspondence with at least one of their lateral ends, suspension connecting rods connected to a respective lateral upright joined to said supporting structure.

11. Modular head according to claim 1, wherein said central supporting structure includes means for connection with other structures for defining a machine with additional heads.

12. Modular head according to claim 1, wherein said advancement means comprise a pair of flexible closed-ring mats reciprocatingly coupled and subtended by motorized rollers in a manner to form adjacent substantially parallel branches ($a_1$, $a_2$) interposed between the work plates connected, respectively, to said central supporting structure (2) and to said beating bodies.

13. Modular head according to claim 1, wherein both of said beating bodies cooperate with a fixed crosspiece rigidly coupled to said fixed central structure, an internal face of which is connected with a respective work plate facing to interact with an opposing plane connected to an external face of an adjacent beating body.

14. Modular balanced machine, for stretching and softening industrial hides, characterized by the fact of being formed by one or more working heads according to any one of claims 1–8, 10, 11, 12 or 13 reciprocatingly connected in positions staggered with respect to the plane of advancement.

15. Modular balanced machine for stretching and softening industrial hides, characterized by the fact of being formed by one or more working heads according to any one of claims 1–8, 10, 11, 12 or 13 reciprocatingly connected in positions vertically superimposed along said work plane.

* * * * *